United States Patent [19]

Richard

[11] 3,986,337

[45] Oct. 19, 1976

[54] THERMOELECTRIC HEATING AND COOLING APPARATUS

[75] Inventor: David A. Richard, San Diego, Calif.

[73] Assignee: Signet Optical Company, San Diego, Calif.

[22] Filed: June 30, 1975

[21] Appl. No.: 591,497

[52] U.S. Cl. ..... 62/3; 165/126

[51] Int. Cl.[2] ..... F25B 21/02

[58] Field of Search ..... 62/3; 165/126; 136/204

[56] References Cited

UNITED STATES PATENTS

| | | | |
|---|---|---|---|
| 2,927,250 | 3/1960 | Scharli | 317/100 |
| 3,230,723 | 1/1966 | Korn | 62/3 |

*Primary Examiner*—William E. Wayner

*Attorney, Agent, or Firm*—Christie, Parker & Hale

[57] ABSTRACT

This invention pertains to an improved thermal slab assembly. A metal slab defines an exterior surface of the assembly and is supported on a hollow chassis. A plurality of thermoelectric devices are conductively engaged with the underside of the slab and are disposed in a regular array relative to each other, whereby each device is assigned a respective one of a corresponding plurality of equal area portions of the slab. Control means are coupled between the slab and the thermoelectric devices for sensing the temperature of the slab and for regulating operation of the devices to establish and maintain a predetermined temperature of the slab. A vertically and parallelly finned heat sink is conductively coupled to each thermoelectric device. Baffle means are located in the housing and are engaged between the chassis floor and the slab, and also with the heat sinks at the outer surfaces of the outer fins thereof and at the lower ends of the fins thereof, for dividing the housing interior into an inner chamber and an outer chamber. The baffle means cooperate with the heat sinks for defining ports between the inner and outer chambers only via the spaces between the fins of the heat sinks. An air flow opening is provided through the chassis to the inner chamber and an air flow opening is provided through the chassis to the outer chamber. A fan is associated with one of the openings for circulating air between the chambers through the ports. The control means includes means for adjusting the predetermined temperature to be established and maintained in the slab by the thermoelectric devices. The control means also includes means for reversing the direction of current flow through the thermoelectric devices so that the assembly may be operated either for heating or for cooling the slab.

8 Claims, 4 Drawing Figures

THERMOELECTRIC HEATING AND COOLING APPARATUS

BACKGROUND OF THE INVENTION

1. Field of the Invention

This invention pertains to thermal slab assemblies and, more particularly, to such assemblies which incorporate a plurality of thermoelectric devices, and in which improved air circulation patterns are established across heat sinks for the devices.

2. Review of the Prior Art

Refrigerating thermal slabs, commonly known as cold slabs, have been used for some years by dentists and dental technicians to facilitate the mixing and storage of certain compounds used by such persons in their professional capacities. An exemplary cold slab for dental use is illustrated in U.S. Pat. No. 3,230,723; as set forth below, this invention provides several improvements over the cold slab described in this patent.

Cold slabs are also useful in occupations and businesses other than dentistry. For example, cold slabs may be used by the processors of ophthalmic lenses in connection with the mounting, into appropriate metal holder rings, of unfinished lenses (glass or resin) preparatory to the grinding of the lenses to define the desired prescriptions. An alloy which melts at a very low temperature is injected in molten form into a cavity defined by the metal holder ring in conjunction with the reverse side of the lens element; the alloy solidifies within the cavity and bonds both to the holder ring and to the lens. It is desirable that the alloy solidify as rapidly as possible upon being injected into the cavity so as to transfer a minimal amount of the heat therein to the lens, thereby minimizing distorting thermal stresses in the lens. For this reason, the metal holder rings commonly are chilled to absorb as much heat as possible, as rapidly as possible, from the molten alloy injected into the cavity. Cold slabs may be used to advantage to chill the metal holder rings.

The metal holder rings used in processing ophthalmic lenses should, in practice of the procedure described above, be as cool as possible, but they should not be wet or moist. Accordingly, the temperature to which the holder rings are chilled should be a temperature which is just above the dewpoint in the environment to which the holder rings are exposed. Since the dewpoint will vary from time to time within a manufacturing operation, despite the presence of air-conditioning or the like, it is desirable that the cold slab used to refrigerate or chill the holder ring be adjustable in terms of temperature established and maintained by the slab or chill plate. Existing chill plate assemblies, which are manufactured principally for use in connection with dentistry, do not provide for adjustment for temperature established and maintained in the work surface of the plate, and also are of rather limited capacity in terms of the requirements of a processor of ophthalmic lenses. Also, existing cold slabs, while being satisfactory for dental purposes, are not capable of establishing and maintaining desired temperatures with the accuracy required in the processing of ophthalmic lenses or for many other industrial and domestic purposes. Accordingly, a need exists for a thermal slab which is of increased capacity in terms of its useful work surface, which may be adjustable in terms of the temperature established and maintained in the work surface, and which is of enhanced accuracy in terms of control over such temperature.

SUMMARY OF THE INVENTION

This invention satisfies the need identified above by providing a thermal slab assembly which is simple, rugged, reliable and efficient, and which has substantially increased work surface capacity as compared to presently available cold slabs. The present thermal slab assembly has the feature that the temperature established and maintained in the thermally controlled slab is adjustable as appropriate to a particular application, and is established and maintained with greater accuracy than heretofore possible in such products. Devices in accord with this invention are referred to herein as thermal slab assemblies in that they may be used to either heat or cool one or more objects placed on the work surface of the assembly. The conversion of the assembly from heating to cooling or vice versa is accomplished simply by operating a switch.

Generally speaking, this invention provides an improved thermal slab assembly which comprises, in combination, a metal slab, a plurality of thermoelectric devices, control means for the thermoelectric devices, heat sinks for each device, and air circulation means including baffles for improved transfer of heat to and from the heat sinks depending upon the mode of operation of the thermoelectric devices for either heating or cooling the slab. The slab defines an exterior surface of the slab assembly and is supported on a hollow chassis having a floor. Each one of the plurality of thermoelectric devices is conductively engaged with the underside of the slab. The devices are arranged in a regular array relative to each other whereby each device is assigned a respective one of corresponding plurality of portions of the slab, which portions are of substantially equal area. The control means are coupled between the slab and the thermoelectric devices for sensing the temperature of the slab and for regulating operation of the devices to establish and maintain a predetermined temperature of the slab. A vertically and parallelly finned heat sink is conductively coupled to each device. Baffle means in the chassis are engaged between the floor and the slab, and also with the heat sinks at the outer surfaces of the outer fins thereof and at the lower ends of the fins, for dividing the housing interior into inner and outer chambers. The baffle means also define ports between the inner and outer chambers only via the spaces between the fins of the heat sinks. Air flow openings are provided through the chassis to the inner and outer chambers. Fan means are associated with one of these openings for circulating air between the chambers through the ports.

DESCRIPTION OF THE DRAWINGS

The above-mentioned and other features of this invention are more fully set forth in the following detailed description of a presently preferred embodiment of the invention, which description is presented with reference to the accompanying drawings, wherein.

DESCRIPTION OF THE ILLUSTRATED EMBODIMENT

Figure 1:
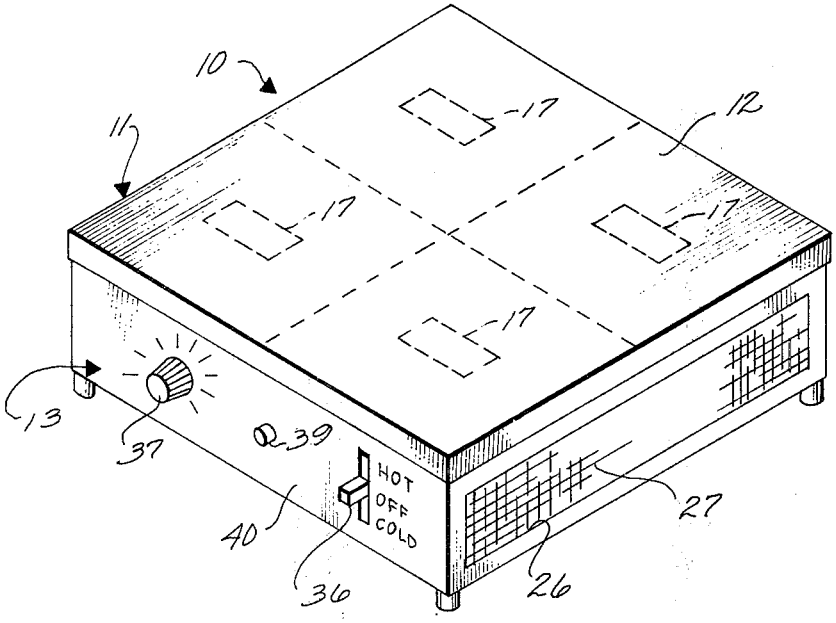
FIG. 1 is a perspective view of a thermal slab assembly.

A heating or cooling thermal slab assembly 10 is composed principally of a square metal slab 11 which defines a flat work surface 12 of the assembly, which work surface is to have its temperature established and controlled at a desired temperature during operation of the slab assembly. Another major component of the slab assembly is a hollow shell-like chassis 13, on the open upper end of which the slab is supported, the lower end of the chassis being closed by a floor 14 (see FIG. 2). In a presently preferred thermal slab assembly, slab 11 is defined by a piece of aluminum plate having dimensions of 17 inches by 17 inches by ¼ inch. The slab preferably is supported above the extreme upper end of the chassis by thermally insulating rubber feet 15 engaged between the underside of the slab and the upper extent of the chassis at the four corners of the assembly. Similar feet 16 are carried by the lower extent of the chassis at the four corners of the assembly for supporting the assembly on a suitable support surface.

Each one of four thermoelectric devices 17 is assigned to a respective quadrant 12' of the slab (see FIG. 4) for establishing and maintaining a desired temperature, either above or below ambient temperature during use of the slab assembly. The thermoelectric devices are engaged conductively with the underside of the slab essentially at the centroid of area of the respective slab quadrant so that the several devices are each assigned an equal area of the slab work surface. The thermoelectric devices preferably are Type CP2-31-06 MELCOR thermoelectric modules obtainable from Materials Electronics Products Corporation, 990 Spruce Street, Trenton, N.J. 08638. These thermoelectric devices are rectangular, wafer-like, semi-conductor devices which produce either heating or cooling, depending upon the direction of flow of electric current therethrough, by the Peltier effect.

A metal heat sink assembly 18 is conductively engaged with the lower surface of each thermoelectric device, the respective device engaging the heat sink assembly in the center of the upper surface of the horizontal base 19 of the sink. A plurality of regularly spaced parallel fins 20 depend from the heat sink base and preferably either are formed integrally with the base or are conductively intimately associated with the base. The fins of the several heat sinks are all aligned parallel to each other as shown best in FIG. 3.

Figure 2:
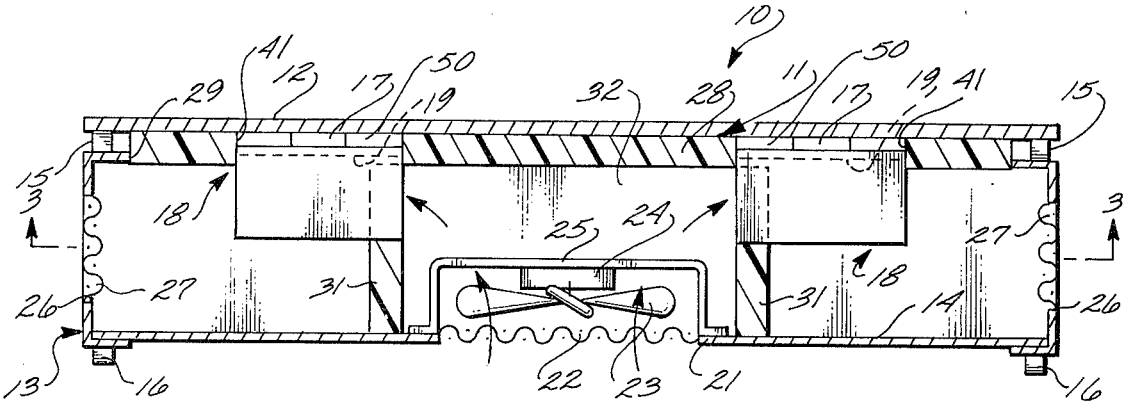
FIG. 2 is a cross-sectional elevation view of the slab assembly.

An air flow opening 21 is formed through the chassis floor at about its center as shown in FIG. 2, and a screen 22 is disposed across the opening within the chassis. A fan 23 and its drive motor 24 are mounted within the chassis over the opening on a suitable bracket 25. Opening 21 is an air inlet opening to the interior of the slab assembly. Two air outlet openings 26 are formed as shown in FIGS. 1, 2 and 3 through the side walls of the chassis and are covered by suitable screen 27.

A layer of thermal insulation material 28 is connected to the underside of slab 11 and covers substantially the entirety of the area of the slab except as required around the periphery of the slab to cause the periphery of the insulation material to register with an opening 29 formed in the top of the chassis. Opening 29 is defined by the ends of horizontal flanges extended inwardly from the upper edges of the vertical walls of the chassis. Accordingly, the flow of air in response to operation of fan 23 is essentially exclusively into the interior of the chassis through air inlet opening 21 and from the chassis through air outlet openings 26. Insulation material 28 conveniently may be a sheet of polyurethane foam 1 inch thick and covered on its lower surface by a film 30 of polyethylene to render the insulation material impermeable to flow of air thereinto from the interior of the chassis. As shown best in FIG. 2, four openings 41 are formed in insulation material 28 to cooperate intimately with the ends and sides of heat sinks 18; thus, each device 17 is located in an insulating dead-air space 50 between the slab and the adjacent heat sink. The fins of the heat sinks depend substantially below the undersurface of insulation layer 28 into the interior of the chassis.

Figure 3:
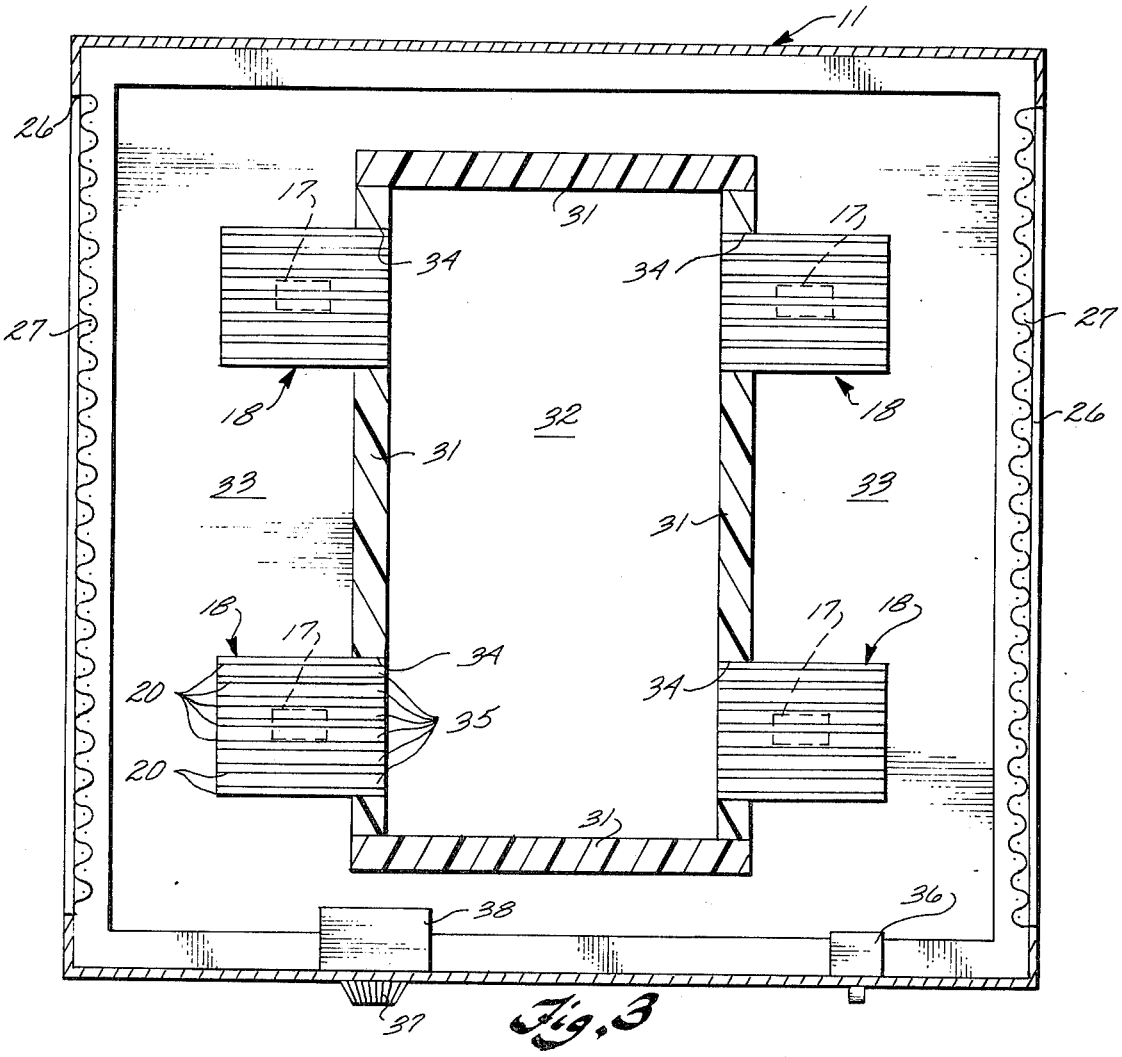
FIG. 3 is a cross-sectional view taken along line 3—3 in FIG. 2.

A baffle 31 is engaged between the chassis floor and the underside of insulation layer 28 to divide the interior of the chassis into an inner chamber 32 centrally of the chassis, to which air inlet opening 21 communicates, and into an outer chamber 33 which, as shown in FIG. 3, preferably surrounds the inner chamber. The air outlet openings 26 communicate to the exterior of the slab assembly from the outer chamber. The baffle preferably is defined by thermal insulation material such as 1 inch thick polyurethane foam carrying a film 30 of polyethylene on one surface thereof to render the baffle impermeable to the flow of air therethrough from the inner chamber to the outer chamber.

As shown in FIG. 3, the baffle defines four notches 34 in its upper extent at locations corresponding to the positions of the heat sinks so that the baffle cooperates intimately with the outer surfaces of the outermost ones of the vertical fins of each heat sink and with the lower ends of the fins. In this manner, the spaces defined between the fins of each heat sink cooperatively define a port 35 communicating the inner and outer chambers with each other, the four ports providing essentially the only air flow path from the inner chamber to the outer chamber.

As shown in FIG. 3, it is preferred that the heat sink assemblies be disposed principally in the outer chamber 33 and only minimally within the inner chamber inside the baffle. In view of the intimate cooperation of the baffle between the chassis floor and the underside of the insulation layer across the bottom of slab 11, and also due to the intimate cooperation of the baffle with the heat sinks as described above, the flow of air into and out of the slab assembly in response to operation of the fan is intimately across the radiative and conductive surfaces of the several heat sinks. This air circulation pattern assures efficient operation of the heat sinks for dissipating heat from the thermoelectric devices during cooling of the slab, and to produce appropriate warming of heat sinks during operation of the thermoelectric devices for heating of the slab. The above-described cooperation of the baffle with the heat sinks and the air flow patterns through the interior of the chassis due to this relationship contributes materially to effective control over the temperature to be established and maintained in the slab by operation of the thermoelectric devices. The presence of insulative material 28 across the bottom surface of the slab contributes materially to minimizing the temperature differential in the slab over the area thereof associated with each of the thermoelectric devices. Thus, in a presently preferred thermal slab assembly according to this invention, a temperature difference of only one-half degree Fahrenheit is manifested between points directly above any one of the thermoelectric devices and the farthest corner of the slab when the controlled temperature of the slab is approximately 44° F. and ambient temperature is room temperature, i.e., about 70° F.

The manually operable controls for the thermal slab assembly consist of a three-position mode selection switch 36 having operative positions corresponding to HOT-OFF-COLD, and a knob 37 of a temperature adjusting potentiometer 38. A neon glow lamp 39 is also mounted on the front face 40 of the chassis so as to be visible from the exterior of the assembly to indicate whether the assembly is in its OFF condition or either of its ON conditions.

Figure 4:
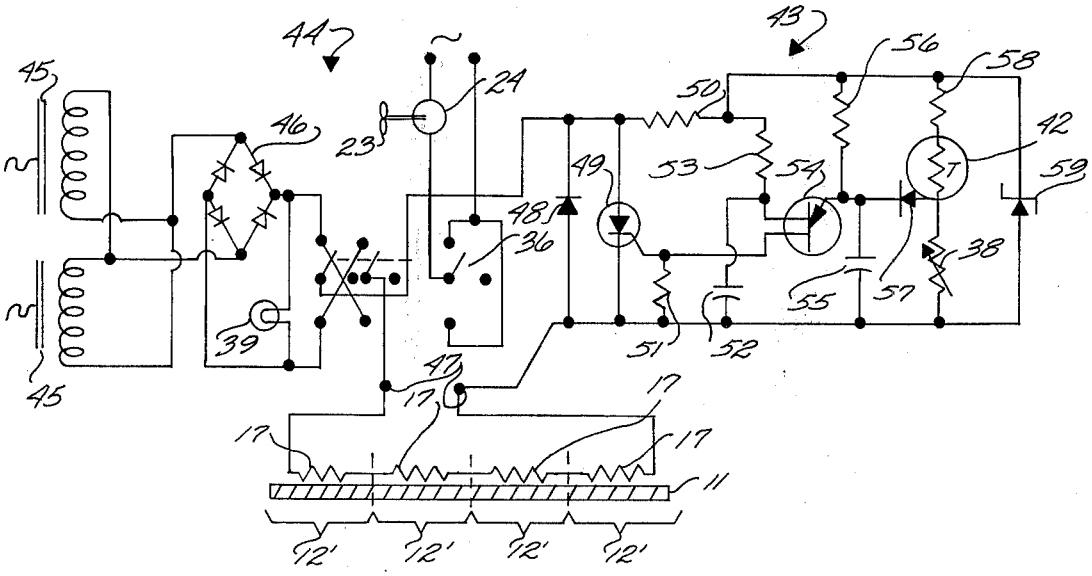
FIG. 4 is a schematic diagram of the power and control circuitry of the slab assembly.

The temperature established in slab 11 by operation of the thermoelectric devices is monitored by a thermistor 42 (see FIG. 4) which is disposed in intimate thermally conductive contact with the underside of the slab, preferably at about the center of area of the slab. The thermistor is wired in series with potentiometer 38 into the control portion 43 of a power and control circuit 44 within the interior of the chassis. Circuit 44 includes two step-down transformers to the primaries of which 115 V AC line power is applied. The transformers preferably are UTC type FT-8 transformers rated at 6V-8 AMPS in the secondary thereof. The transformers are connected in parallel across the input terminals of a full wave rectifier bridge 46 which may be a Motorola MDA 980-3 bridge. The output terminals of the rectifier bridge are connected to mode selection switch 36 which is a triple pole, double throw switch having a center OFF position. Two of the poles of switch 36 are used for reversing the polarity of the voltage supplied by the rectifier bridge to the control portion 43 of the circuit; the third pole of the mode selection switch is wired to control in an ON/OFF manner, operation of fan motor 24. Thermoelectric devices 17 are connected in series across the load terminals 47 of circuit 44 in series with the temperature control portion 43 of the circuit, the function of which is to regulate the supply of current to the thermoelectric devices in response to the operation of thermistor 42 to maintain a desired temperature in slab 11 as established by the setting of potentiometer 38. The potentiometer, in series with the thermistor, serves as an adjustable bias resistor for the thermistor. The remaining elements of the temperature control portion of circuit 44 are interconnected as shown in FIG. 4 and have the characteristics set forth in the following table:

| Circuit Component Number | Description |
|---|---|
| 48 | 1N4004 rectifier diode |
| 49 | 2N6397 12 amp. silicon controlled rectifier |
| 50 | 6.8K ohm, 2 watt |
| 51 | 47 ohm, ½ watt |
| 52 | 0.1 mfd, 25V |
| 53 | 1K ohm, ½ watt carbon |
| 54 | 2N2646 unijunction transistor |
| 55 | 0.03 mfd, 25V |
| 56 | 75K ohm, ½ watt |
| 57 | 1N4001 rectifier diode |
| 58 | 39K ohm |
| 59 | 1 watt, 16 V Zener diode |

Where the temperature control portion of the circuit is defined by components having the characteristics set forth above, the thermistor preferably is a 1,000 ohm negative temperature coefficient thermistor and the potentiometer is a 1,000 ohm ½ watt linear taper trimming potentiometer such as FENWAL type KA 3151 thermistor. The Zener diode 59 is optional depending on the application; with the diode, the control circuit is a half wave arrangement, and without it a full wave arrangement is provided.

From the preceding description, it will be apparent that thermal slab assembly 10 has many uses. The slab assembly is particularly useful to processors of glass or resin ophthalmic lenses in that it may be used in its cooling mode to chill the metal holder rings for lens elements to a temperature adjusted to be just above the dewpoint in the particular environment in which the slab assembly is located. The slab assembly may also be used by dentists and the like. Also, because the slab assembly can be operated in either its heating mode or its cooling mode by appropriate operation of selector switch 36, the slab assembly may have many uses in the home, for example, where it can be used on a buffet to maintain either hot or cold dishes at the desired temperature. The slab assembly, in the preferred form described above, is compact and has overall dimensions of 17 inches × 17 inches × approximately 3 inches.

Persons skilled in the art to which this invention pertains will appreciate that the foregoing description has been presented in respect to a presently preferred thermal slab assembly according to this invention and that modifications, alterations or changes in the arrangements described above may be made without departing from the scope of this invention. Accordingly, the preceding description should not be considered as limiting the fair scope of this invention as set forth in the following claims.

What is claimed is:

1. An improved thermal slab assembly comprising, in combination, a metal slab defining an exterior surface of the assembly and supported on a chassis having a hollow interior and a floor, a plurality of thermoelectric devices conductively engaged with the underside of the slab and disposed in a regular array relative to each other whereby each device is assigned a respective one of a corresponding plurality of portions of the slab which are of substantially equal area, control means coupled between the slab and the thermoelectric devices for sensing the temperature of the slab and for regulating operation of the devices to establish and maintain a predetermined temperature of the slab, a vertically and parallelly finned heat sink conductively coupled to each device, baffle means in the chassis engaged between the floor and the slab and with the heat sinks at the outer surfaces of the outer fins thereof, and at the lower ends of the fins for dividing the housing interior into inner and outer chambers and for defining ports between the inner and outer chambers only via the spaces between the fins of the heat sinks, air flow openings through the chassis to the inner and outer chambers, and fan means associated with one of said openings for circulating air between the chambers through the ports.

2. Apparatus according to claim 1 wherein the outer chamber is arranged to surround the inner chamber, and the fan means is associated with the inner chamber's air flow opening for drawing air into the housing.

3. Apparatus according to claim 1 wherein the baffle means is defined by thermal insulation material which is impermeable to the flow of air therethrough.

4. Apparatus according to claim 1 including a layer of thermal insulation material over substantially the entirety of the underside of the slab around the thermoelectric devices.

5. Apparatus according to claim 4 wherein the insulation material is substantially impermeable to the flow of air therethrough.

6. Apparatus according to claim 1 wherein the means coupled between the slab and the thermoelectric devices includes means operable from the exterior of the assembly for adjusting the temperature established and maintained by the devices.

7. Apparatus according to claim 1 including selectively operable means operable from the exterior of the assembly for reversing the direction of current flow through the thermoelectric devices for either heating or cooling of the slab by the devices.

8. In a thermal slab assembly including a metal slab defining an exterior surface of the assembly and supported on a chassis having a hollow interior and a floor, thermoelectric means conductively engaged with the underside of the slab, means coupled between the slab and the thermoelectric means for sensing the temperature of the slab and for regulating operation of said means to establish and maintain a predetermined temperature of the slab, a vertically and parallelly finned heat sink conductively coupled to the thermoelectric means, air flow openings to and from the interior of the chassis, and fan means associated with one of said openings for circulating air through the interior of the chassis, the improvement being characterized in that the thermoelectric means comprises a plurality of thermoelectric devices disposed in a regular array relative to each other whereby each device is assigned a respective one of a corresponding plurality of portions of the slab which are of substantially equal area, and a heat sink for each device disposed in the chassis, and in that the assembly further includes baffle means in the housing engaged between the floor and the slab and with the heat sinks at the outer surfaces of the outer fins thereof and at the lower ends of the fins thereof for dividing the housing interior into an inner chamber and an outer chamber and for defining ports between the inner and outer chambers only via the spaces between the fins of the heat sinks, the circulation of air through the interior of the chassis being between the chambers through the ports.

* * * * *